US008414358B2

(12) United States Patent
Balbi et al.

(10) Patent No.: US 8,414,358 B2
(45) Date of Patent: Apr. 9, 2013

(54) CORNER BEVELLING ASSEMBLY FOR BEVELLING CORNERS OF GLASS SHEETS

(75) Inventors: Mario Balbi, Cuneo (IT); Salvatore Cantoro, Vinovo (IT); Andrea Tonda Roch, Turin (IT); Giovanni Vidotto, Chieri (IT)

(73) Assignee: Bottero S.p.A., Cuneo (IT)

( * ) Notice: Subject to any disclaimer, the term of this patent is extended or adjusted under 35 U.S.C. 154(b) by 443 days.

(21) Appl. No.: 12/769,005

(22) Filed: Apr. 28, 2010

(65) Prior Publication Data

US 2010/0279588 A1 Nov. 4, 2010

(30) Foreign Application Priority Data

Apr. 29, 2009 (IT) ..... TO2009A0342

(51) Int. Cl.
*B24B 1/00* (2006.01)

(52) U.S. Cl. ..... 451/44; 451/5; 451/11; 451/43; 451/190

(58) Field of Classification Search ..... 451/5, 8, 451/10, 43, 44, 12, 26, 190, 236, 121, 336
See application file for complete search history.

(56) References Cited

U.S. PATENT DOCUMENTS

| | | | | |
|---|---|---|---|---|
| 3,928,945 | A * | 12/1975 | Devillers | 451/190 |
| 4,528,780 | A * | 7/1985 | Halberschmidt et al. | 451/14 |
| 4,667,443 | A * | 5/1987 | Sakurai et al. | 451/236 |
| 4,739,590 | A * | 4/1988 | Myers et al. | 451/44 |
| 4,756,124 | A * | 7/1988 | Rossi et al. | 451/5 |
| 5,099,617 | A * | 3/1992 | Bovone | 451/44 |
| 5,613,894 | A * | 3/1997 | Delle Vedove | 451/1 |
| 5,928,060 | A * | 7/1999 | Miller | 451/5 |
| 6,231,429 | B1 * | 5/2001 | Lisec | 451/44 |
| 6,325,704 | B1 * | 12/2001 | Brown et al. | 451/44 |
| 6,602,120 | B2 * | 8/2003 | Bavelloni | 451/236 |
| 6,855,030 | B2 * | 2/2005 | Halley | 451/5 |
| 6,887,140 | B2 * | 5/2005 | Bovone | 451/246 |

(Continued)

FOREIGN PATENT DOCUMENTS

| | | | |
|---|---|---|---|
| EP | 1 422 024 | A1 | 5/2004 |
| EP | 1 488 886 | A1 | 12/2004 |
| EP | 1 769 885 | A1 | 4/2007 |

OTHER PUBLICATIONS

Italian search report dated Dec. 28, 2009 from corresponding IT TO20090342.

*Primary Examiner* — George Nguyen
(74) *Attorney, Agent, or Firm* — Ohlandt, Greeley, Ruggiero and Perle, L.L.P.

(57) ABSTRACT

The corners of a sheet of glass travelling in a longitudinal direction are ground by a corner bevelling assembly having a fixed frame; a movable frame; a grinding wheel; a supporting arm supporting the grinding wheel and fitted to the movable frame; and an actuating device interposed between the fixed frame and the movable frame, and having a first powered guide-slide assembly for moving the movable frame in a direction parallel to a longitudinal travelling direction of the sheet, and a second powered guide-slide assembly for moving the movable frame with respect to the fixed frame in a transverse direction perpendicular to the longitudinal direction; the corner bevelling assembly also having a reference locator which, in use, is positioned against a longitudinal lateral surface, parallel to the longitudinal direction, of the sheet; a relative-motion assembly for enabling movement, parallel to the transverse direction, of the reference locator with respect to the supporting arm; and a device for detecting the position of the reference locator with respect to the supporting arm.

10 Claims, 6 Drawing Sheets

U.S. PATENT DOCUMENTS 7,001,249 B1 * 2/2006 Pride et al. ..... 451/21
7,094,128 B2 * 8/2006 Vianello et al. ..... 451/5
2002/0006771 A1 * 1/2002 Bavelloni ..... 451/65
2002/0034927 A1 * 3/2002 Bavelloni ..... 451/236

* cited by examiner 27a
28
27
28a
3

4
42
7
28
22
18
16
11a
14
12a
18a
1
21
20
19
15
13a
10
5
14a
13
8
12
11
9

CORNER BEVELLING ASSEMBLY FOR BEVELLING CORNERS OF GLASS SHEETS

The present invention relates to a corner bevelling assembly for bevelling corners of glass sheets.

BACKGROUND OF THE INVENTION

In sheet glass grinding, so-called two-sided grinding machines are used, which comprise a succession of grinding wheels for grinding the opposite lateral edges of the sheet; and two corner bevelling assemblies, downstream from the grinding wheels in the travelling direction of the sheet, for grinding the front and rear corners of the sheet.

Each corner bevelling assembly comprises a vertical-axis grinding wheel; a first powered guide-slide assembly for moving the grinding wheel in a longitudinal direction parallel to the travelling direction of the sheet; and a second powered guide-slide assembly for moving the grinding wheel to and from a forward work position in a transverse direction perpendicular to the longitudinal direction.

To grind the corners of the sheet, the sheet is fed longitudinally towards the corner bevelling assembly at a given speed; as the sheet moves forward, the grinding wheel is moved in the transverse direction towards the sheet and into a given forward work position by the second guide-slide assembly; and, once the position of the sheet is determined, the first guide-slide assembly eases the grinding wheel towards the sheet in the longitudinal direction, to minimize impact between the sheet and the grinding wheel waiting in the forward work position.

Though widely used, known corner bevelling assemblies of the above type have two drawbacks. Firstly, the grinding wheel is difficult to control, or at least accurately enough to minimize impact between the sheet and the grinding wheel, thus resulting in chipping or breakage of the sheet, which is therefore eventually rejected.

Secondly, they fail to ensure identical grinding of all the corners of the sheet, which, after grinding the perimeter, is therefore aesthetically unacceptable.

The above is mainly due to wear of the sheet conveyors and/or errors in detecting the position of the sheet making it difficult to determine the exact position of the sheet on the conveyor, close to the corner bevelling assembly.

SUMMARY OF THE INVENTION

It is an object of the present invention to provide a corner bevelling assembly for bevelling corners of glass sheets, designed to provide a simple, low-cost solution to the above problems.

According to the present invention, there is provided a corner bevelling assembly for bevelling corners of glass sheets, the assembly comprising a fixed frame; a movable frame; a grinding wheel; a supporting arm for supporting said grinding wheel and connected to said movable frame; and an actuating device interposed between said fixed frame and said movable frame, and in turn comprising a first powered guide-slide assembly for moving the movable frame in a direction parallel to a longitudinal travelling direction of a work sheet of glass, and a second powered guide-slide assembly for moving said movable frame and said supporting arm with respect to the fixed frame in a transverse direction perpendicular to said longitudinal direction; the assembly being characterized by also comprising a reference locator which, in use, is positioned against a longitudinal lateral surface, parallel to said longitudinal direction, of said sheet; relative-motion means for enabling movement, parallel to said transverse direction, of said reference locator with respect to said supporting arm; detecting means for detecting the position of said reference locator with respect to the supporting arm; and control means for controlling said second guide-slide assembly as a function of the position of said reference locator.

The present invention also relates to a grinding method for bevelling corners of glass sheets.

According to the present invention, there is provided a grinding method, as claimed in the attached Claims.

BRIEF DESCRIPTION OF THE DRAWINGS

A number of non-limiting embodiments of the invention will be described by way of example with reference to the accompanying drawings, in which.

DETAILED DESCRIPTION OF THE INVENTION

Figures 1, 4:
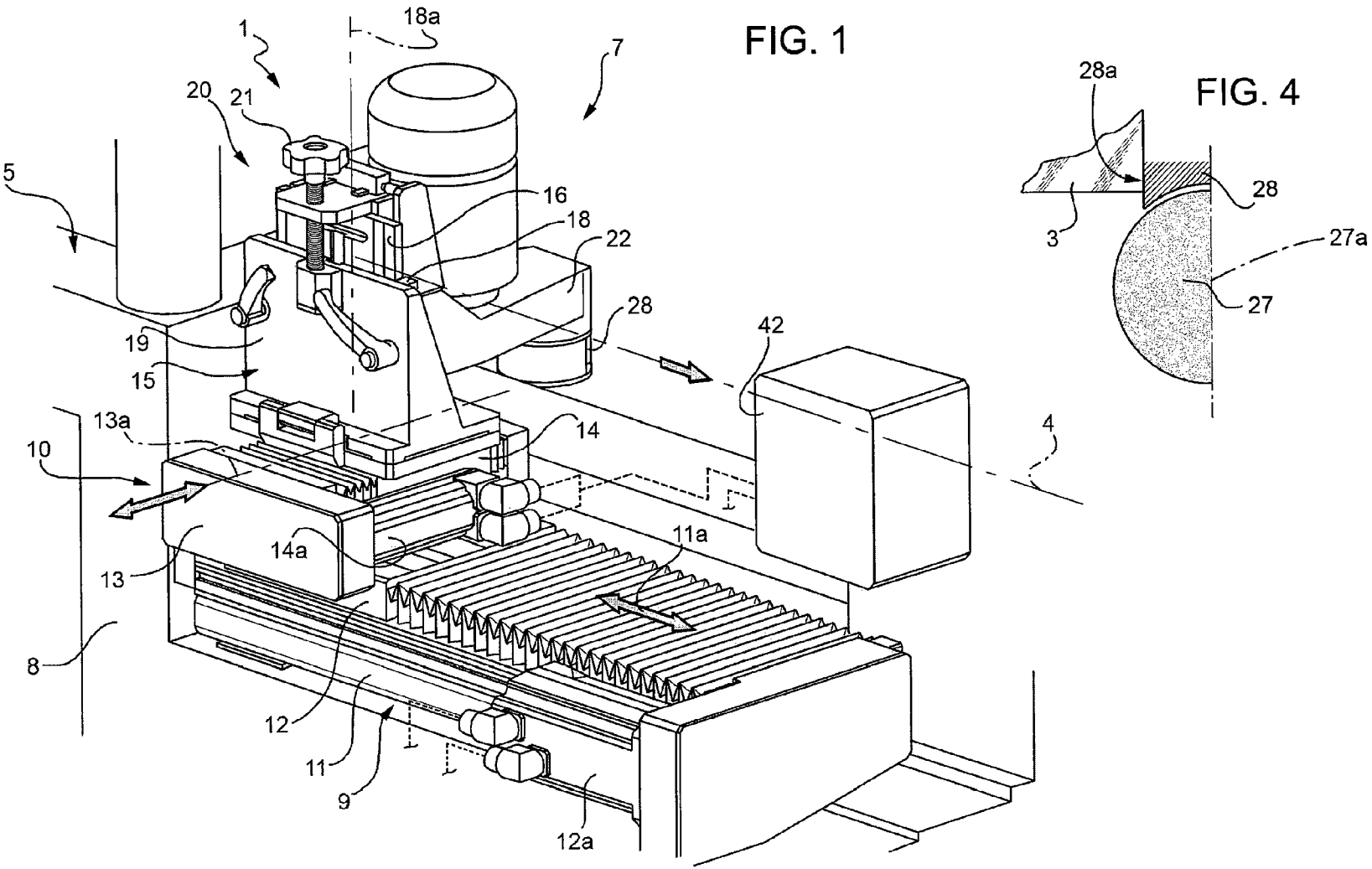
FIG. 1 shows a view in perspective of a preferred embodiment of a corner bevelling assembly in accordance with the teachings of the present invention.
FIG. 4 shows, schematically, the arrangement of some of the parts in FIGS. 3*a*-3*f*.

Number 1 in FIG. 1 indicates as a whole a system for grinding glass sheets, and which comprises a known powered line conveyor 2 (not described in detail) for feeding a work sheet 3 in a longitudinal travelling direction 4 (FIGS. 1 and 3*a*-3*f*); a known two-sided grinding machine 5 (shown partly) for grinding the longitudinal lateral surfaces of sheet 3; and a corner bevelling assembly 7 for bevelling the front and rear corners of sheet 3.

Assembly 7 comprises a fixed frame 8; and two perpendicular powered guide-slide assemblies 9 and 10. Assembly 9 comprises a straight guide 11 fitted integrally to frame 8; and a slide 12 fitted to guide 11 to slide back and forth in a direction 11*a* parallel to longitudinal direction 4 and under the control of a respective actuator 12*a*, preferably an electric motor.

Slide 12 is fitted integrally with a straight guide 13 of assembly 10, the slide 14 of which slides back and forth along guide 13 in a transverse direction 13*a*, perpendicular to directions 4 and 11*a*, and under the control of a respective actuator 14*a*, preferably an electric motor.

An inverted-T-shaped supporting body 15 extends upwards from slide 14, is hinged to slide 14 in known manner to rotate about a hinge axis parallel to direction 11*a*, and is fitted with a mounting plate or frame 16. Plate 16 is fitted to a fixed guide 18, fitted to a vertical wall 19 of body 15, to slide up and down in a vertical direction 18*a* perpendicular to directions 11*a* and 13*a*, and under the control of a screw-nut screw assembly 20 operated by a knob 21.

Figure 2:
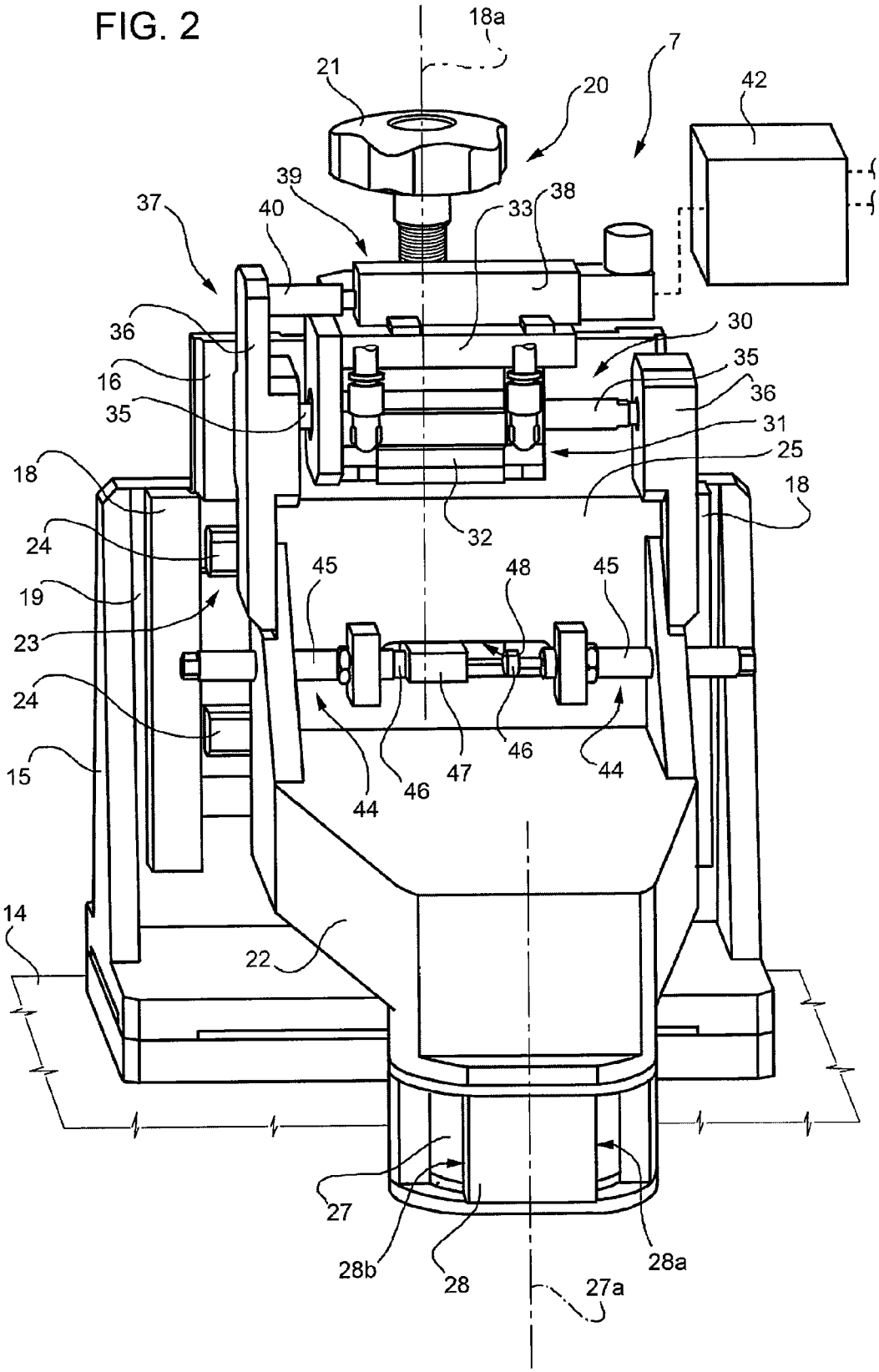
FIG. 2 shows a side view, with parts removed for clarity, of the FIG. 1 corner bevelling assembly.

With reference to FIGS. 1 and 2, assembly 7 also comprises a grinding wheel arm 22 projecting from and connected to mounting plate 16 by a guide-slide assembly 23 (FIG. 2).

Assembly 23 comprises two straight guides 24 fitted integrally to mounting plate 16 and parallel to directions 4 and 11*a*; and a slide 25 fitted to guides 24 to slide back and forth, and fitted firmly with a rear connecting portion of arm 22. At its free end opposite the rear connecting portion, arm 22 is fitted with a powered grinding wheel 27 fitted to arm 22 to rotate about a vertical axis 27*a*, perpendicular to directions 4, 11*a* and 13*a*, under the control of a respective electric motor. On the opposite side of grinding wheel 27 to slide 25, arm 22 is fitted integrally, in a fixed position with respect to grinding wheel 27, with a locator 28 for arresting the front and rear lateral surfaces 3*a*, 3*b* of sheet 3 perpendicular to longitudinal direction 4.

With reference to FIG. 2, locator 28 is bounded longitudinally by two opposite flat surfaces 28*a*, 28*b* parallel to each other and perpendicular to longitudinal direction 4. Each surface 28*a*, 28*b* is located at a distance from grinding wheel 27, and is designed and positioned to lie in a plane parallel to axis 27*a* of grinding wheel 27, perpendicular to direction 4, and intersecting grinding wheel 27, so as to define a stop for part of the front lateral surface 3*a* or rear lateral surface 3*b* of work sheet 3.

In a variation not shown, locator 28 is defined by at least one cylindrical body with a generating line parallel to axis 27*a* of grinding wheel 27, but still at a distance from grinding wheel 27.

With specific reference to FIG. 2, a flexible compensating device 30 is interposed between arm 22 and mounting plate 16, to move arm 22 longitudinally with respect to plate 16, and so permit, in use, controlled movement of arm 22, and therefore of locator 28, with respect to plate 16 by the thrust exerted by sheet 3 on either one of surfaces 28*a* and 28*b* of locator 28.

With reference to FIG. 2, device 30 comprises a double-acting pneumatic linear actuator 31, which in turn comprises an outer casing 32 fitted integrally to mounting plate 16 by a platelike body 33 of screw-nut screw assembly 20; and two opposite output rods 35 having opposite end portions, each connected to a respective arm 36 of a top fork 37 of arm 22.

Platelike body 33 of screw-nut screw assembly 20 is also fitted firmly with an outer casing 38 of a linear position transducer 39, a movable output member 40 of which is connected to one of arms 36. Transducer 39 is connected electrically to a known comparing and control unit 42, to which actuators 12*a* and 14*a* of guide-slide assemblies 9 and 10 are also connected.

With reference to FIG. 2, device 30 also comprises two opposite stop decelerators 44 for limiting the movement of arm 22 to two limit positions. More specifically, the two decelerators have respective casings 45 fitted integrally to arm 22; and respective sliding members 46 on opposite sides of a reference appendix 47 integral with plate 16 and projecting from plate 16 through a longitudinal opening 48 formed through slide 25.

With reference to FIGS. 3*a*-3*f*, and starting with slides 12 and 14 in a withdrawn position, the corners of sheet 3 are ground as follows.

Figure 3A:
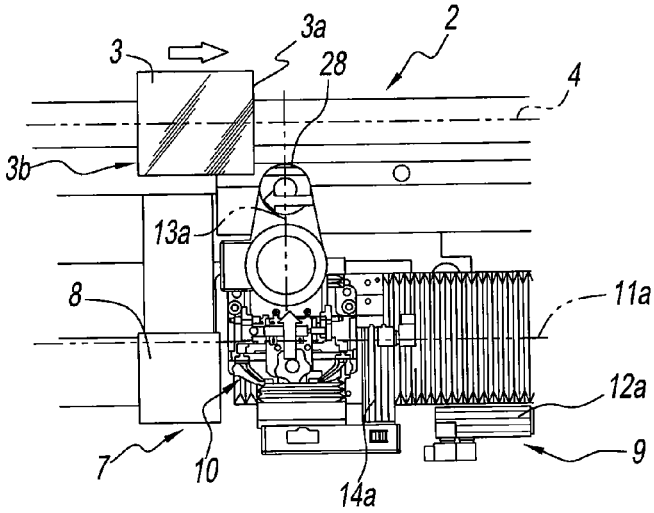
FIGS. 3*a*-3*f* show top plan views of the FIGS. 1 and 2 corner bevelling assembly in six different operating positions.

When sheet 3, travelling in longitudinal direction 4, is intercepted by a known detecting device (not shown), actuator 14*a* is operated and locator 28 moved into a forward intercept position (FIG. 3*a*). More specifically, the intercept position is designed so that, as the sheet contacts the locator, the work corner of the sheet comes to rest against surface 28*a* and therefore still at a distance from grinding wheel 27, with no possibility of interfering with the grinding wheel (FIG. 4). At the same time, linear actuator 31 is powered to move arm 22, and therefore locator 28, rapidly with respect to mounting plate 16 towards the incoming sheet 3, as shown in FIG. 3*a*.

At this point, actuator 12*a* is operated to move inverted-T-shaped supporting body 15 in the same travelling direction as sheet 3, but at a slower speed, so as to gradually reduce the relative speed and therefore the distance between locator 28 and sheet 3. Linear actuator 31 continues to be powered, but at a lower pressure than for the fast movement of arm 22 towards sheet 3, and which varies according to the size of sheet 3, as explained below.

As lateral surface 3*a* of sheet 3 comes to rest against surface 28*a* of locator 28 (FIG. 4), sheet 3 exerts thrust on locator 28, so that arm 22 moves gradually with respect to mounting plate 16 in the travelling direction of sheet 3. In which case, actuator 31 performs like an air spring, the resistance or opposition of which can be adjusted according to operating conditions and/or the type of incoming sheet 3, to achieve a fine adjustment of the force exchanged between sheet 3 and locator 28. The movement of arm 22, as a result of the thrust exerted by the sheet, continues, together with the movement of inverted-T-shaped supporting body 15 in longitudinal direction 4, until a balance is reached, i.e. until the relative speed of sheet 3 and locator 28, and therefore grinding wheel 27, in the longitudinal direction equals zero.

To achieve this, when the movement of arm 22 with respect to plate 16, detected by transducer 39, exceeds a given threshold value—set in unit 42 and selected to prevent linear actuator 31 from reaching its limit position, and to ensure contact between sheet 3 and locator 28—transducer 39 sends a position signal to unit 42, which commands actuator 12*a* to accelerate slide 12 in the travelling direction of sheet 3 and so reduce the difference in speed between sheet 3 and slide 12, until slide 12 reaches the same speed as sheet 3, with arm 22 positioned halfway along its travel along guides 24. The movement of arm 22 with respect to plate 16 as a consequence of actual contact between sheet 3 and locator 28 is thus compensated.

Figure 3B:
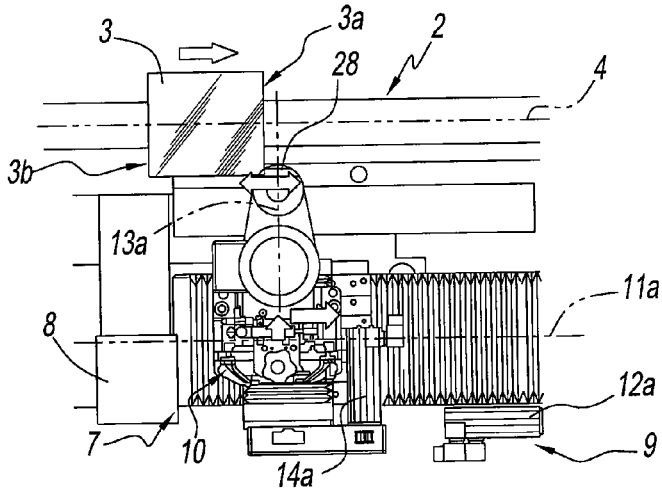

As soon as the relative speed between locator 28 and sheet 3 is steadied at zero, and sheet-locator contact pressure is substantially constant, actuator 14*a* is operated to ease grinding wheel 27 towards the sheet and grind the front corner, as shown in FIG. 3*b*.

Figure 3C:
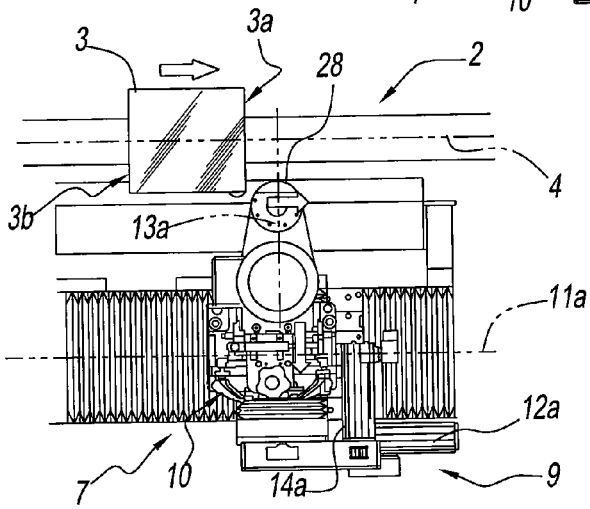
Figure 3D:
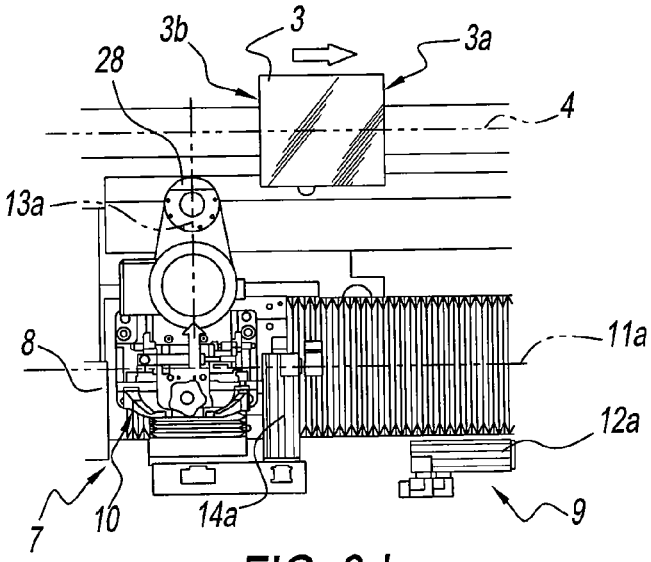
Figure 3E:
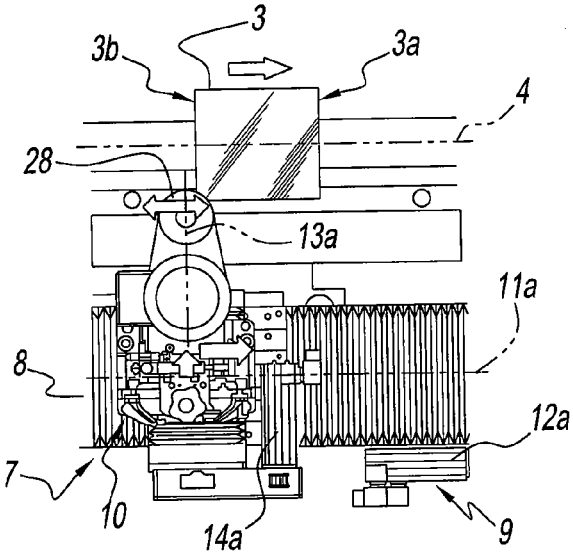
Figure 3F:
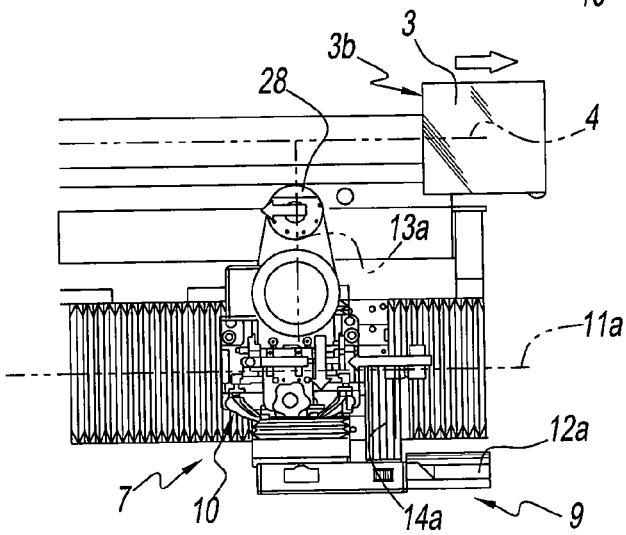

Once the corner is ground, actuator 12*a* is operated to withdraw grinding wheel 27 from sheet 3, followed by operation of actuator 14*a* to move grinding wheel 27 back to the start position (FIG. 3*c*). At this point, actuator 12*a* is operated again to move grinding wheel 27 to the rear of sheet 3, and actuator 14*a* is operated to move the grinding wheel back into the forward intercept position (FIG. 3*d*). Once the grinding wheel is in the forward intercept position, actuator 31 is operated to move arm 22, with respect to plate 16, towards sheet 3, and actuator 12*a* is operated to move plate 16 and arm 22 towards sheet 3, travelling ahead of the arm, at a faster speed than that of sheet 3. As lateral surface 3*b* of sheet 3 nears surface 28*b* of locator 28, the feed pressure of actuator 31 is adjusted, so that it acts as an air spring, in exactly the same way as for the front corner. When the difference in speed brings sheet 3 to rest against surface 28*b* of locator 28, arm 22 starts moving with respect to plate 16, in the same way as for the front corner, and from this moment on and until stable contact is achieved, unit 42 controls the movement of actuator 12*a* as described above (FIG. 3*e*). Once stable contact between sheet 3 and locator 28 is achieved, actuator 14*a* is operated to move grinding wheel 27 onto sheet 3 and grind the rear corner. At this point, the grinding wheel is withdrawn from sheet 3 into the start position, waiting for the front corner of the next work sheet 3.

Figure 5:
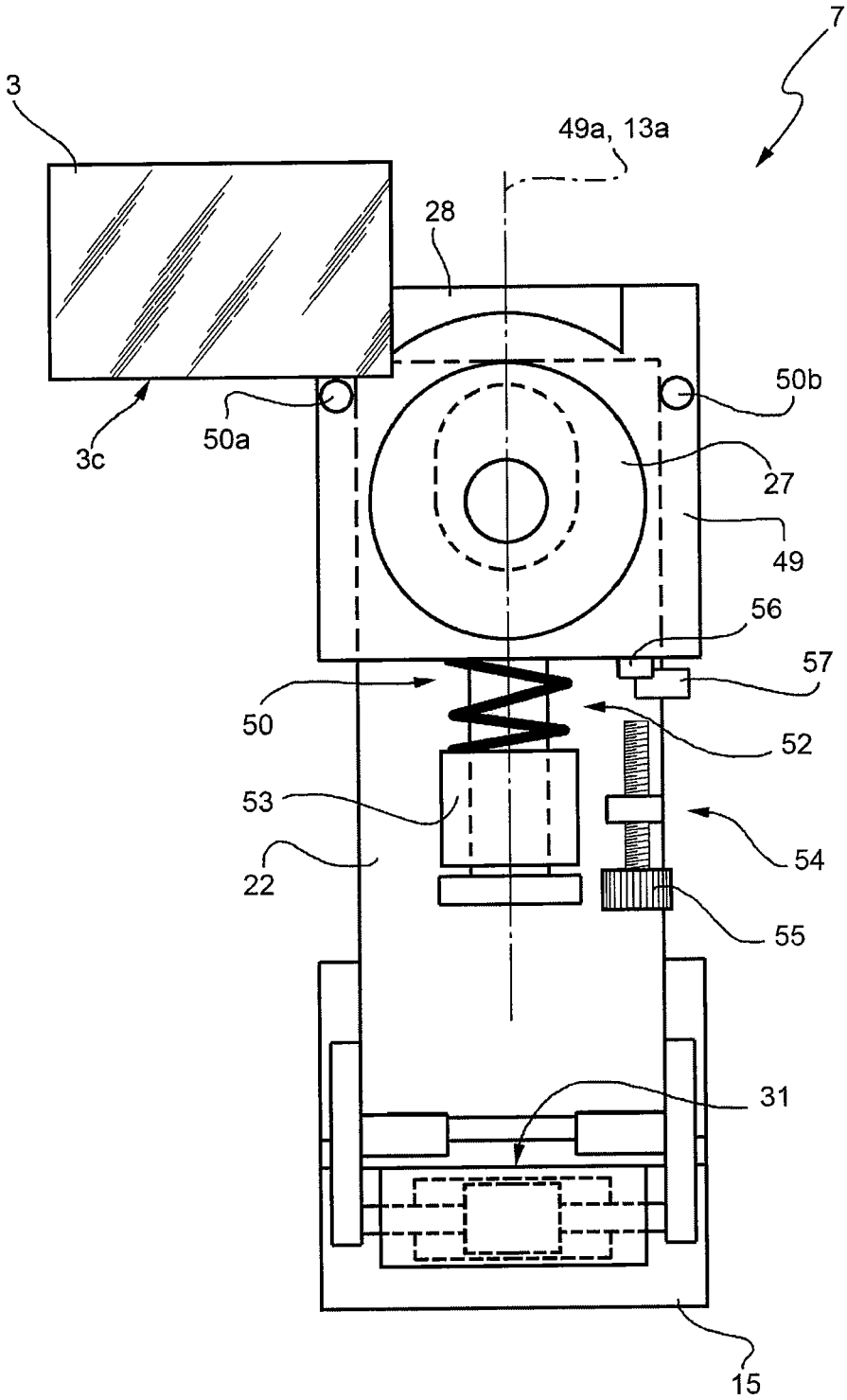
FIGS. 5 and 6 show schematics, with parts removed for clarity, of two variations of part of the FIG. 1 corner bevelling assembly.

In the FIG. 5 variation, locator 28 is movable with respect to arm 22. More specifically, locator 28 is fitted to a guide-slide assembly 50 comprising a guide 53 connected integrally to arm 22, and a slide 49 fitted to guide 53 to slide in a direction 49*a* parallel to direction 13*a*, and is connected integrally to a front end portion of slide 49. An adjustable stop device 54 is interposed between arm 22 and slide 49 to determine the position of slide 49 with respect to arm 22, and which comprises a screw 55 screwed to a nut screw integral with arm 22; and a stop shoulder 56 carried by slide 49 and which cooperates with the end of screw 55. Shoulder 56 is associated with an electric switch 57 connected electrically to unit 42 to supply unit 42 with a signal to stop actuator 14*a* when the end of screw 55 rests against shoulder 56, i.e. when the slide is in the withdrawn limit position.

With reference to FIG. 5, two lateral reference locators 50*a*, 50*b* are fitted firmly or in rotary manner to slide 49, are aligned in a direction parallel to longitudinal direction 4, and extend perpendicular to sheet 3 and directions 4, 11*a* and 13*a* to cooperate, in use, with a longitudinal lateral surface 3*c* of sheet 3 parallel to the longitudinal direction.

Slide 49 is moved into a forward limit position by a linear actuator 52, which, in the example shown, is a mechanical actuator comprising a variably preloaded spring. Alternatively, actuator 52 is pneumatic or electromechanical, both controlled by respective control units (not shown) connected to unit 42.

Figure 6:
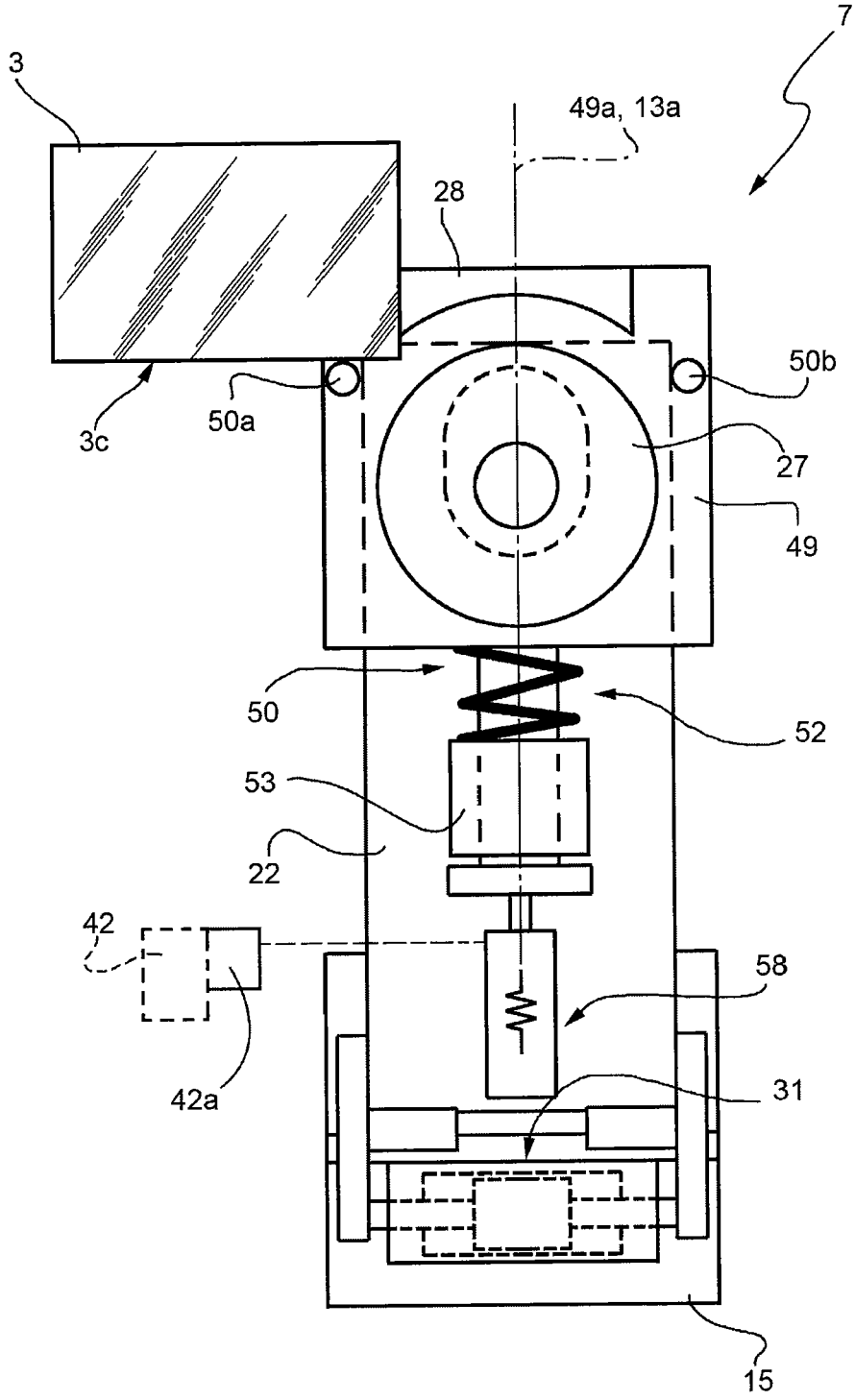

In the FIG. 6 variation, stop device 54 is replaced by a position transducer 58 for determining the position of slide 49 with respect to arm 22 in direction 49*a*, and for sending a corresponding position signal to unit 42.

In actual use, sheet 3 travels in longitudinal direction 4 until it comes to rest against locator 28, as described above; in which situation, lateral locators 50*a*, 50*b* are detached from longitudinal lateral surface 3*c* of sheet 3, so as not to interfere with sheet 3. As arm 22, and therefore grinding wheel 27, moves towards sheet 3 in direction 13*a* to grind the corner, slide 49, pushed by actuator 52 into the forward position, moves integrally with arm 22 until one of locators 50*a*, 50*b* contacts longitudinal lateral surface 3*c* of sheet 3. At this point, slide 49 starts moving with respect to arm 22, and grinding of the corner commences. Grinding is terminated when shoulder 56 contacts screw 55, and switch 57 sends a stop signal to unit 42 to stop actuator 14*a*. Positioning sheet 3 against locators 50*a*, 50*b* provides for positioning the sheet correctly with respect to the grinding wheel and so ensuring consistent grinding and dimensional consistency of the ground corner.

In the FIG. 6 variation, as longitudinal lateral surface 3*c* of sheet 3 comes to rest against one of locators 50*a*, 50*b*, transducer 58 begins determining the movement of slide 49 with respect to arm 22, and sends a movement signal to unit 42, which comprises a comparing block 42*a* for comparing the movement signal with a reference signal stored in unit 42, and stops actuator 14*a*, and therefore grinding of the corner, when the signal from transducer 58 equals the reference signal.

As will be clear from the above description, assembly 7 described provides above all for preventing any direct contact between the moving sheet 3 and grinding wheel 27. In fact, in assembly 7 described, as the sheet 3 on conveyor 2 nears grinding wheel 27, it comes to rest against locator 28, which keeps it at a distance from grinding wheel 27, thus reducing, or even completely eliminating, the risk of chipping or breaking the sheet, and/or uneven wear of grinding wheel 27 caused mainly by a moving element, such as the sheet, contacting a fast-rotating member, such as the grinding wheel.

Regardless of wear of sheet conveyor 2 and/or any dimensional errors or errors in detecting the position of sheet 3 in the longitudinal direction, the locator 28 and compensating device 30 combination provides not only for smooth, steady sheet-locator contact, but also for accurately controlling sheet-locator contact pressure, so that it is minimum or at any rate always below a predetermined threshold, regardless of the size, and therefore weight, of the sheet.

Locators 50*a*, 50*b* associated with the stop device or transducer provide for moving the grinding wheel in direction 13*a* with respect to longitudinal lateral surface 3*c* by the same amount at all times, thus ensuring consistent grinding of the corner, regardless of any dimensional or positioning errors of sheet 3 in transverse direction 13*a*.

Employing an ordinary pneumatic, electromagnetic or mechanical actuator obviously guarantees sheet-locator contact every time, thus ensuring geometric and dimensional consistency of the ground part. In assembly 7, in fact, the corners are ground by feeding grinding wheel 27 towards sheet 3 in direction 13*a*, but only when sheet 3 and locator 28 are moving in unison, and sheet 3 is therefore longitudinally and transversely stationary with respect to grinding wheel 27.

When grinding the corner, sheet 3 is maintained in sliding contact with locator 28 and in contact with locators 50*a*, 50*b* at all times, which means the sheet is ground in the same conditions as if the sheet were stationary inside a grinding station, into which the grinding wheel is moved.

Clearly, changes may be made to assembly 7 as described herein without, however, departing from the protective scope as defined in the accompanying Claims. More specifically, the guide-slide assemblies, locator 28, or the elastic devices interposed between arm 22 and the slide supporting arm 22 may differ from those described herein.

Finally, assembly 7 may obviously have no locator 28; in which case, the position of sheet 3 in longitudinal direction 4 may be determined by detecting devices located, for example, along the route of the sheet. Moreover, locator 28 may be fitted to slide 49, as opposed to arm 22.

The invention claimed is:

1. A corner bevelling assembly for bevelling corners of glass sheets, the corner bevelling assembly comprising a fixed frame; a movable frame; a grinding wheel; a supporting arm for supporting said grinding wheel and connected to said movable frame; and an actuating device interposed between said fixed frame and said movable frame, and in turn comprising a first powered guide-slide assembly for moving the movable frame in a direction parallel to a longitudinal travelling direction of a work sheet of glass, and a second powered guide-slide assembly for moving said movable frame and said supporting arm with respect to the fixed frame in a transverse direction perpendicular to said longitudinal travelling direction; a reference locator which, in use, is positioned against a longitudinal lateral surface, parallel to said longitudinal travelling direction, of said work sheet; relative-motion means for enabling movement, parallel to said transverse direction, of said reference locator with respect to said supporting arm; detecting means for detecting a position of said reference locator with respect to the supporting arm; and control means for controlling said second powered guide-slide assembly as a function of the position of said reference locator.

2. A corner bevelling assembly as claimed in claim 1, wherein said reference locator is movable, with respect to said supporting arm, between two limit stop positions.

3. A corner bevelling assembly as claimed in claim 1, further comprising a slide fitted to said supporting arm to slide back and forth with respect to the supporting arm in a direction parallel to said transverse direction; and elastically flexible means interposed between said slide and said supporting arm to keep the slide in a first forward limit position towards said longitudinal travelling direction; said reference locator being carried by said slide.

4. A corner bevelling assembly as claimed in claim 3, wherein said detecting means comprise adjustable stop means interposed between said slide and said supporting arm to stop the slide in a second withdrawn limit position opposite said first forward limit position; disabling means being provided to disable said second powered guide-slide assembly when said slide is in said second withdrawn limit position.

5. A corner bevelling assembly as claimed in claim 3, wherein said detecting means comprise transducer means for determining a position of said slide with respect to said supporting arm; and comparing means for comparing a signal from said transducer means with a reference signal; disabling means being provided to disable said second powered guide-slide assembly when the signal from said transducer means equals said reference signal.

6. A corner bevelling assembly as claimed in claim 3, wherein said slide is also fitted with a further locator defining a stop for a front or rear lateral surface, parallel to said transverse direction, of said work sheet.

7. A grinding method for bevelling corners of a glass sheet by means of said corner bevelling assembly as claimed in claim 1, and comprising the steps of feeding said work sheet of glass in said longitudinal travelling direction; and grinding said corners by means of said grinding wheel; moving said reference locator into contact with said longitudinal lateral surface, parallel to said longitudinal travelling direction, of said work sheet; allowing movement of said reference locator with respect to said supporting arm in a direction parallel to said transverse direction; determining the position of said reference locator with respect to said supporting arm; and controlling said second powered guide-slide assembly as a function of the position of said reference locator.

8. A grinding method as claimed in claim 7, wherein the position of said reference locator with respect to said supporting arm is determined by moving said reference locator into a first forward limit position towards said longitudinal travelling direction; and allowing said reference locator to return to a second withdrawn limit position opposite said first forward limit position; said second powered guide-slide assembly being disabled when said reference locator is in said second withdrawn limit position.

9. A grinding method as claimed in claim 7, wherein the position of said reference locator is determined by moving said reference locator into a first forward limit position towards said longitudinal travelling direction; and allowing said reference locator to return to a second withdrawn limit position opposite said first forward limit position; disabling said second powered guide-slide assembly comprising the steps of determining the position of said reference locator with respect to said supporting arm; comparing the determined position of said reference locator with a reference position; and stopping said second powered guide-slide assembly when the determined position matches the reference position.

10. A grinding method as claimed in claim 7, wherein a corner is ground with the work sheet in a fixed position, in said longitudinal travelling direction, with respect to said grinding wheel; and by subsequently moving said grinding wheel in said transverse direction towards said work sheet.

* * * * *